US005181846A

United States Patent [19]

Chang

[11] Patent Number: 5,181,846

[45] Date of Patent: Jan. 26, 1993

[54] SAFETY APPARATUS IN GAS HEATING DEVICE

[75] Inventor: Ui Y. Chang, Seoul, Rep. of Korea

[73] Assignee: Samsung Electronics Co., Ltd., Suweon, Rep. of Korea

[21] Appl. No.: 744,964

[22] Filed: Aug. 14, 1991

[30] Foreign Application Priority Data

Aug. 16, 1990 [KR] Rep. of Korea ..... 90-12620

[51] Int. Cl.[5] ..... F23N 5/10

[52] U.S. Cl. ..... 431/80; 431/78; 251/129.15

[58] Field of Search ..... 431/80, 78; 251/73, 251/129.15

[56] References Cited

U.S. PATENT DOCUMENTS 3,034,571 5/1962 Matthews ..... 431/80 X 3,258,659 6/1966 Schmid et al. ..... 431/80 X

*Primary Examiner*—Larry Jones

*Attorney, Agent, or Firm*—Robert E. Bushnell

[57] ABSTRACT

A safety apparatus for use with a gas burner having a thermoelectrically activated on-off safety valve for controlling gas flow to the burner, a governor for maintaining constant gas pressure to the burner, a gas channel interconnecting safety valve and governor, and a thermocouple for generating a thermoelectromotive force in the presence of a flame to electrically maintain the safety valve in an open position, is disclosed. The safety apparatus includes a gas pressure operator for sensing a predetermined excessive pressure within the gas channel and which initiates a shut-off of the gas supply to the burner upon sensing the high pressure gas in the channel. A connecting device is electrically connected to a solenoid in the safety valve for controlling the on/off position of the safety valve and is electrically connected to the thermocouple. An operation sensing device is in communication with the gas pressure operator such that when in the presence of the predetermined high gas pressure the gas pressure operator senses such high pressure gas in the channel and activates the operation sensing device to electrically disconnect the generated thermoelectromotive force supplied to the safety valve such that the safety valve moves to an off position thereby stopping the flow of gas within the channel and extinguishing the flame at the burner.

8 Claims, 4 Drawing Sheets

SAFETY APPARATUS IN GAS HEATING DEVICE

BACKGROUND OF INVENTION

Field of the Invention

The present invention is related to safety apparatus for use in a gas heating device such as a gas stove and a gas burner and the like, and more particularly to a safety apparatus interconnected with sensing devices which is able to sense a change in the status of the burner or the presence of excessive gas pressure, each of which necessitates terminating gas flow to the burner to protect the burner device and the operating environment of the burner.

At first, operation of an ignition button or knob sparks an ignition plug when a safety valve is open to ignite a pilot burner and simultaneously a main burner.

A thermocouple near the pilot burner heated by the flame of the pilot burner causing a thermoelectromotive force at a solenoid valve to open a safety valve gas channel. Thus, gas from a gas reservoir is fed to the main burner continuously.

Holding the ignition button or knob for a few seconds to supply gas to the pilot burner in order to support combustion thereat, heats the thermocouple and generates thermoelectromotive force to open the safety valve channel in the presence of a flame. However, if the pilot burner is not burning and the button is pressed to allow gas to enter channel 5, gas is still supplied to the burner.

The heating of the thermocouple by operating the corresponding igniting button or manual handle for a few seconds in the presence of a flame, maintains the thermoelectromotive force needed to open the safety valve and continuously supply the firing gas regardless of the absence of the flame of the pilot burner.

Among many types of gas heating devices, two typical models are mentioned below. One model has the gas reservoir which is storable in the body of the gas heating device. Thus, this type is portable and can be moved with relative ease. The other model has the gas reservoir positioned away from the body of the gas heating device. This model uses a reservoir positioned either inside or outside of where the device is used.

In the case of a portable or storable type of heating device, the reservoir is located near the flame of the burner. Thus, the reservoir may overheat, increasing the pressure of the gas within the reservoir. A problem may result from the increased pressure in the reservoir since an explosion could result in the event that the reservoir or the gas conveying channel from the reservoir is ruptured and leaks gas into the air in the presence of a gas igniting device such as a flame or spark.

Also, in case of the reservoir separated type, the reservoir may be exposed to a high temperature area or an abnormal situation such as a fire in a location near the place the reservoir is stored. Thus, the gas pressure within the reservoir may increase excessively creating the potential for an explosion.

Furthermore, as long as the burner is operating continuously, the body of the gas heating device may be inclined or turned upside down, the thermocouple will still detect a flame and keep the safety valve in an open position. Under such conditions the continuous supply of gas to the burner creates another potential problem.

in order to prevent such mishaps, U.S. Pat. No. 4,429,682 teaches an automatic safety gas heating device. A valve rod actuates not only a microswitch, but also a disc valve. A pilot burner and a main burner are separately controlled by individual solenoid operated valves which are serially connected. The disc valve is positioned upstream of the pilot burner, and between the two solenoid operated valves. This safeguards against an erroneous on-state of the microswitch. A sensor will, according to the presence of the pilot flame, instruct an electric control board to continue or discontinue the sparking of an igniter or open or close the solenoid valve for supplying gas to the main burner. Therefore, the overheating of the gas burner can be avoided.

However, the prior art device does not consider the excess pressure in the gas reservoir or other combined factors from any other detecting operators.

SUMMARY OF THE INVENTION

An object of the present invention is to provide a safety apparatus in a gas heating device for solving the above problems.

Another object of the present invention is to provide a safety apparatus for a gas heating device which is able to be installed utilizing a wire extending from a thermocouple which induces a thermoelectromotive force to a safety valve, the operation sensing device detecting excessive pressure in the gas supply pressure which necessitates terminating gas flow to the burner to protect the burner device and the operating environment of the burner.

In accordance with the present invention, the safety apparatus includes a connecting device and an operating sensing device elected connected to the connecting device. The operation sensing device is electrically connected to the thermocouple, thereby detecting a change in the status of the burner (thermocouple) and excessive pressure in the gas supply (operation sensing device), each of which necessitates terminating gas flow to the burner to protect the burner device and the operating environment of the burner.

The connecting device receives two wires from the thermocouple. One of the two wires is insulated and is connected to one terminal of the connecting device and continues to the operation sensing device so as to be connected in series. A wire leads from the operating sensing device and back to the other terminal of the connecting device where it couples with a wire from a solenoid of the safety valve. The other wire exiting the thermocouple couples with a metal body of the safety valve through a metal body of the connecting device, thereby providing a ground circuit.

As a result of the above structure, when a change in the operational environment of the burner device arises, such as an excessive rise in the gas supply pressure, the themoelectromotive force in the safety valve drops off, and the open/close device of the safety valve closes the gas supply channel, to protect the operating environment of the burner, i.e. prevent a potential explosion.

In other words, when the gas supply pressure is over a predetermined value the gas pressure operator senses the excessive pressure and initiates a shut-off of the gas supply to prevent an accident, such as an explosion, from taking place.

Furthermore, when the gas heating device is overslanted against a predetermined level as a change factor of the circumference, an abnormal situation managing operator is installed, therefore, an accident such as a firing rendered from an incessant combustion is avoided.

Furthermore, when a gas heating device is required to operate for a predetermined firing time, a time operator is installed, therefore, users can use the gas heating device with reliance.

Therefore, one kind of the operators mentioned above may be used alone, but also an adequate combination of two or more and the operation sensing device may be cooperating with the operators individually, even burner is firing a thermoelectromotive circuit disconnects and a metal core loses a magnetism, thereby shutting off a gas channel in the safety valve.

BRIEF DESCRIPTION OF DRAWINGS

The invention will be explained in detail below by reference to the accompanying drawings, in which.

DETAILED DESCRIPTION OF A PREFERRED EMBODIMENT OF THE INVENTION

Figure 1:
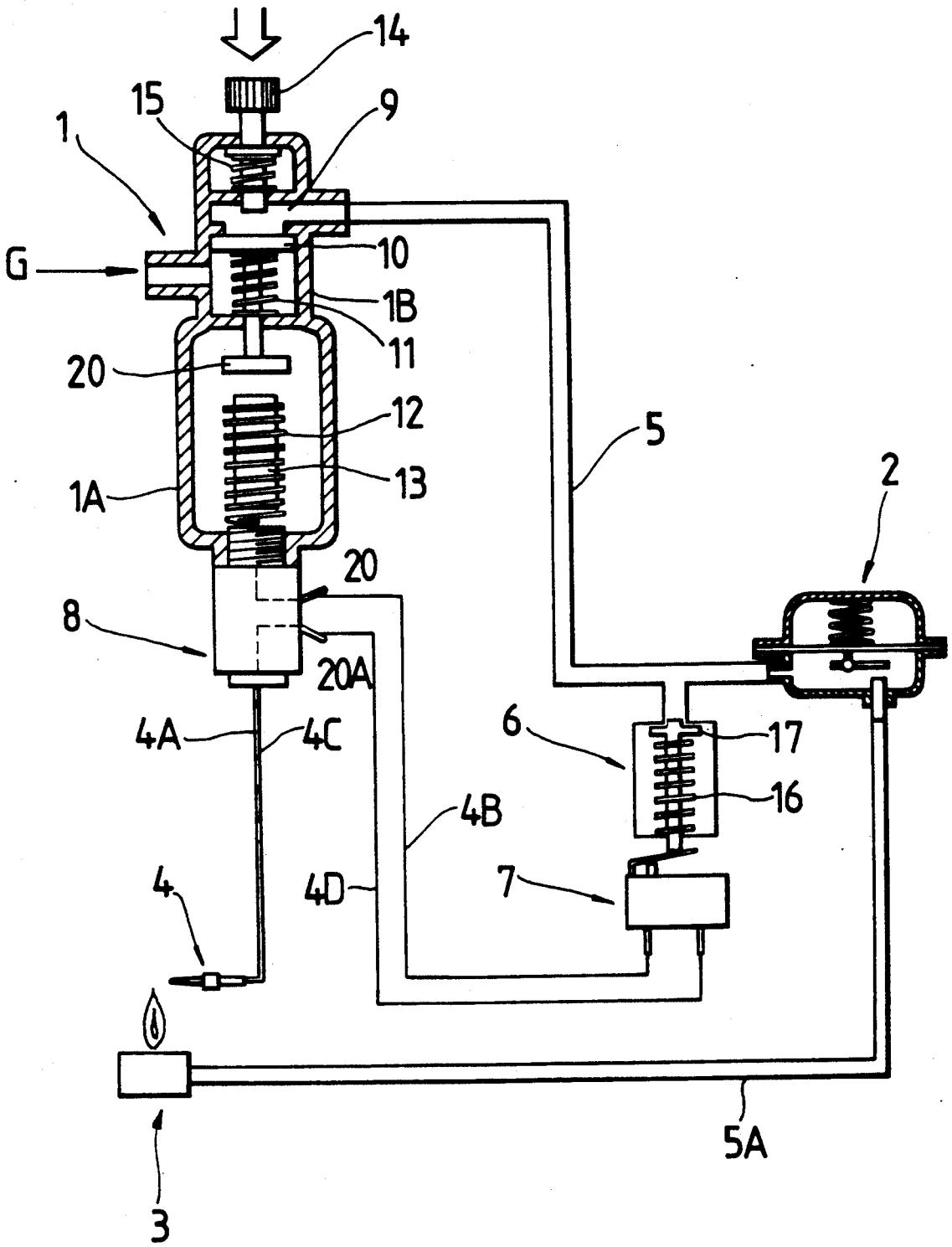
FIG. 1 illustrates the operating and connecting device of the present invention in a gas supply system.

The gas supply circuit of FIG. 1 includes a safety valve 1, which controls the gas fed into a gas channel 5 from a gas reservoir (not shown), a governor 2, which supplies gas fed through the channel 5 to a burner 3 at a constant pressure, and a thermocouple 4 which detects the flame of the burner 3 and creates a thermoelectromotive force to keep open a gas channel 9 of the safety valve 1.

Figure 2:
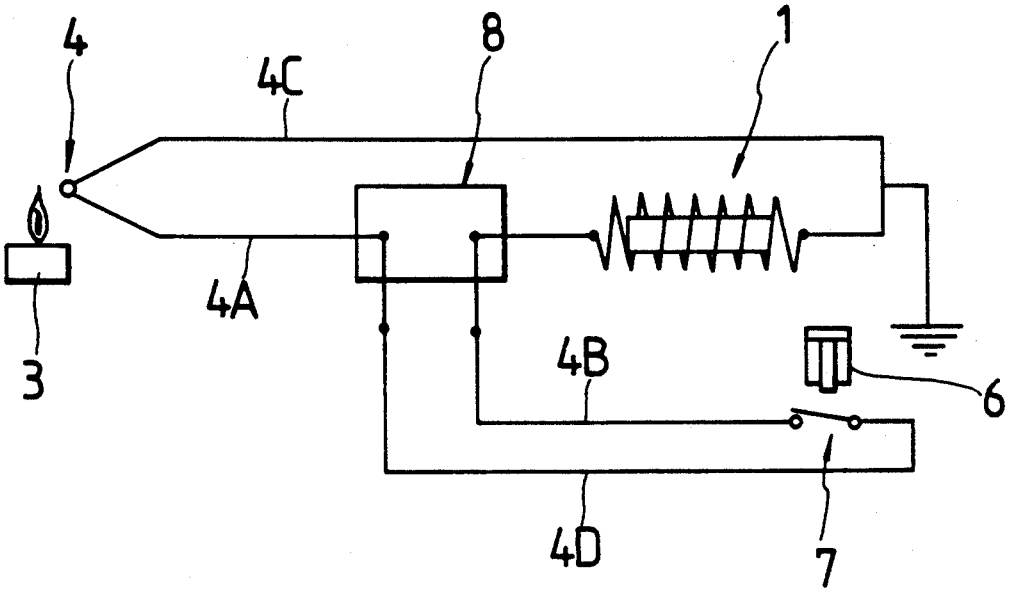
FIG. 2 is an electrical circuit diagram for thermoelectromotive force according to the present invention.

The safety apparatus of the present invention includes a connecting device 8 and an operation sensing device 7. The connecting device 8 is electrically connected (insulated wire 4A) to the thermocouple 4 and is electrically connected to the safety valve 1 which is connected to the thermocouple 4 (exposed wire 4C). The connecting device 8 is electrically connected to the operation sensing device 7 by wires 4D and 4B, as seen in FIG. 2.

In FIG. 1, the gas pressure operator 6 which cooperates with the operation sensing device 7 illustrates one example of safety operators.

The gas supply "G" enters the gas channel 5 after first passing through the safety valve 1. The gas pressure operator 6, which cooperates with the operation sensing device 7, is positioned after the safety valve 1 and before the governor 2.

Figure 3:
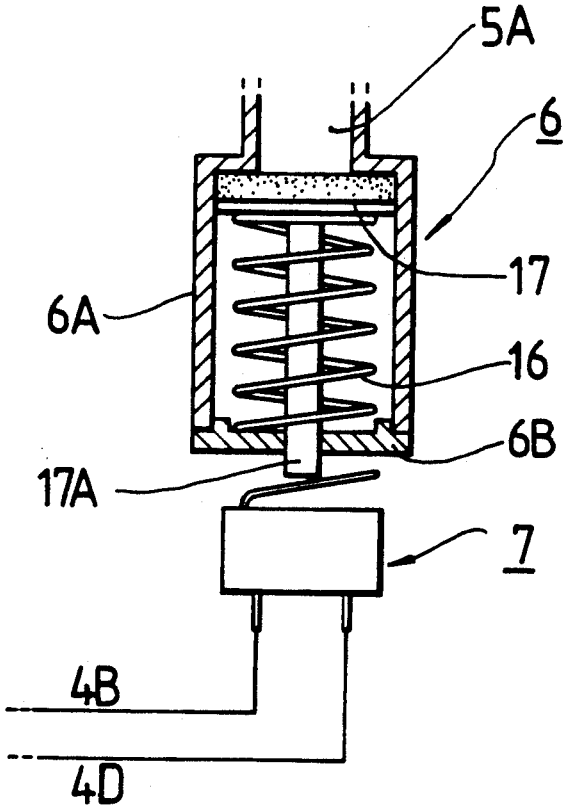
FIG. 3 is a cross section of gas pressure operator in one embodiment.

In FIG. 3, the gas pressure operator 6 is illustrated. The operator 6 includes a body 6A, an operating member 17 (e.g. rubber piston) closed tightly against a pressurized portion 5A under a predetermined pressure of the gas channel 5, an elastic device 16 (e.g. spring) tensioned against the back of the operating member 17 and against the cover 6B, and an operating bar 17A connected to the back of the operating member 17 and encircled by the elastic device 16. The operating member 17 acts as a piston and the operating bar 17A acts as a rod, both of which move upward and downward in the chamber of the pressure operator and with the rod passing through an opening of the cover 6B. The operating bar 17A is mechanically connected via a lever to the operation sensing device 7.

Figure 4:
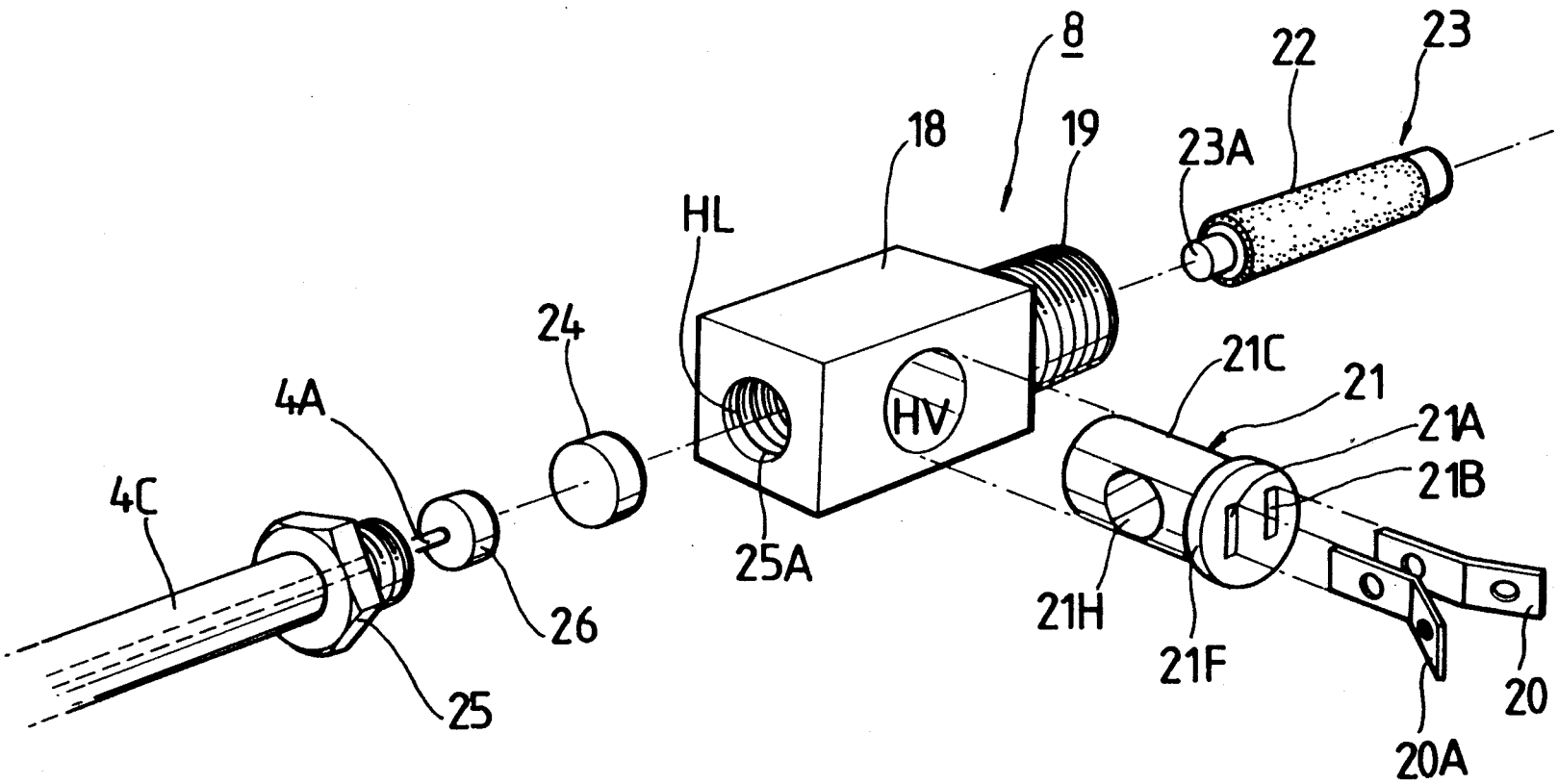
FIG. 4 is an exploded view illustrating the connector according to the present invention.
Figure 5:
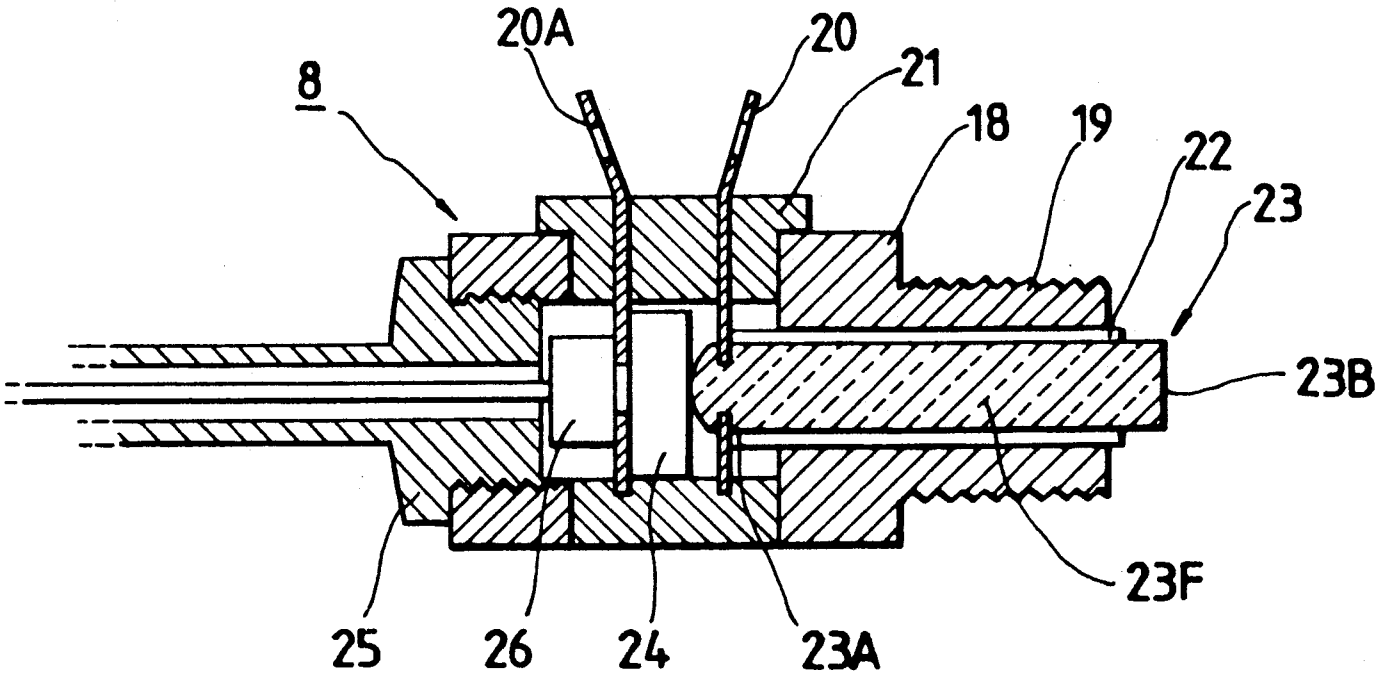
FIG. 5 is a cross section of the connector according to the present invention.

In FIGS. 4 and 5, the connecting device 8 in the present invention includes a metal body 18 having a good electrical conductivity. In this embodiment, the body 18 is formed as a cube. In one side of the body 18, a female threaded portion 25A is formed to threadedly engage the exposed wire 4C which extends from the thermocouple 4. At the opposite side of the body 18, a male threaded portion 19 is formed to threadedly couple with the safety valve 1. Also, a horizontal passage HL is formed in the body 18 and extends between the threaded portions 25A,19. In another face as shown in FIG. 4, a vertical passage HV is formed in the body 18 vertically against the horizontal passage HL. Into the vertical passage HV an insulated inserting device 21 is inserted. The inserting device 21 is constructed with a column 21C in a lower part, and a flange 21F in an upper part. The height of the column 21C is the same as the length of the vertical passage HV. The height of the flange 21F is greater than the diameter of the vertical passage HV. The column 21C has a horizontal passage 21H formed in the middle thereof, to enable the horizontal passage HL of the body to pass therethrough. The flange 21F has slots 21A, 21B formed into the top of the flange 21F to an upper surface of the horizontal passage 21H. The slots 21A, 21B are spaced apart from each other a predetermined distance.

The inserting device 21 is inserted through the vertical passage HV of the body 18, and in the horizontal passage 21H an insulated block 24 is set with standing on its own end. In this case, a round and relatively small diameter to one of the horizontal passage 21H is adapted. One side of the block 24 is in contact with one side of the out-terminal 20A which is inserted through the slot 21A. The other side of the block 24 is in contact with one end of a transmission device 23 which is illustrated in FIG. 5, and the in-terminal 20 is inserted through the slot 21B in contact with the one end of the transmission device 23.

The transmission device 23 is inserted through an inner part of the male threaded portion 19. The transmission device 23 includes a transmission shaft 23F and an insulating member 22. The insulating member 22 is placed between the external surface of the transmission shaft 23F (electrically conductive) and the inner part of the male threaded portion 19. The other end 23B of the transmission device 23 is connected to a solenoid 12 of the safety valve 1.

Into the female threaded portion 25A of the body 18, the exposed wire 4C is connected by a coupling device 25, thereby contacting the exposed wire 4C with the metal body 18. At the same time the exposed wire 4C has the insulated wire 4A coaxially positioned therein. The insulated wire 4A includes a contacting terminal 26 at its end, and the end-terminal 26 is in contact with the other side of out-terminal 20A, as seen in FIG. 5. As mentioned above, the connecting device 8 in the present invention is assembled as depicted in FIG. 5.

The out-terminal 20A is electrically connected to the operation sensing device 7 via the insulated wire 4D as shown in FIG. 3 and the in-terminal 20 is electrically connected to the operation sensing device 7 via the insulated wire 4B as shown in FIG. 3.

Hence, the safety apparatus in the present invention is coupled as in FIGS. 1 and 2.

That is, the exposed wire 4C of the thermocouple is coupled with the metal body 18 of the connecting device 8 by the coupling device 25 and the connecting device 8 is coupled with the metal body 1A of the safety valve 1, thereby being formed a ground circuit. The insulated wire 4A is connected to the connecting device 8, and is led from the out-terminal 20A to connect to the operation sensing device 7, and the insulated wire 4B is led back to the in-terminal 20 from the operating sensing device 7, and the transmission shaft 23F in contact with the in-terminal 20 is connected to the solenoid 12 of the safety valve 1, thereby completing an electrical circuit.

The safety apparatus in the present invention operates as follows, with reference to FIG. 1.

Pushing a control button 14, a rod of the button 14 pushes the open/shut member 10 against a spring 15, and the open/shut member 10 pushes a magnet 20 to move it downward against a spring 11 in a cylinder 1B, thereby opening the fuel gas channel "G" (depicted as an arrow). Gas now feeds though the gas channel 5, the governor 2, and the gas channel 5A to supply the main burner (not shown) and the pilot burner 3 simultaneously. The pilot burner 3 heats the thermocouple 4, which generates a current (thermoelectromotive force), thereby allowing the metal core 13 to be magnetized. The metal core 13 pulls against the magnet 20 which is formed integrally with the open/shut member 10. A channel 9 is thus opened to supply gas to the pilot burner 3 for continual burning.

To illustrate a change in the operational environment, for example, when the gas pressure of the gas reservoir reaches a value greater than a predetermined safe value due to excessive heat, over-pressured fuel, or the like, the pressure of the gas pushes the operating member 17 of the pressure operator 6, which is set to move once a predetermined gas pressure is reached, by the spring 16, the operation sensing device 7 is then activated by the operating bar 17A pushing against the lever of the operation sensing device 7. That is, the operation sensing device 7 electrically disconnects wires 4D and 4B. The core 13 then looses its magnetism and can not pull against the magnet 20 any more. The open/shut device 10 is enabled to an "off" position with a bounding of the spring 11 to shut the fuel gas channel 9. Accordingly, even though the burner 3 is burning continually, the thermoelectromotive force is lost with the change [e.g. fuel gas over-pressure], and the gas channel is shut off. Therefore, a mishap such as fuel gas reservoir explosion is prevented.

At this time, an abnormal situation managing operator and/or a time operator may be installed in series between the wire 4D and the wire 4B according to the user's demand. Therefore, in the event that any one of the operators mentioned above is activated, current is no longer supplied to the solenoid in the safety valve and the metal core losses its magnetism and the fuel gas channel is shut off, thereby establishing the combined safety apparatus.

What is claimed is:

1. A safety apparatus for controlling a gas burner, said safety apparatus comprising:

a safety valve for interrupting fuel gas to the gas burner;

a governor for maintaining constant gas pressure to the gas burner;

a thermocouple generating an electrical current in response to a flame emanating from the gas burner;

connecting means for providing an electrical coupling between a solenoid actuating said safety valve and said thermocouple; and operation sensing means, for series connecting said thermocouple to the solenoid at the connecting means, for interrupting said electrical current from said thermocouple to said solenoid to thereby, shut off a flow of fuel gas through said safety valve in response to occurrence of particular operation conditions.

2. A safety apparatus according to claim 1, wherein said connecting means comprises:

a body having formed therein a first horizontal passage interconnected with a longitudinal passage;

inserting means disposed within said longitudinal passage and providing a second horizontal passage formed therein cooperating with said first horizontal passage;

a first terminal and a second terminal positioned at opposing ends of said second horizontal passage;

block of an electrically insulating material disposed between and spacing part said first terminal and said second terminal;

wherein said body electrically couples an exposed wire of said thermocouple at a first end of said first horizontal passage, an insulated wire of said thermocouple passes into said first end of said first horizontal passage to electrically couple with said first terminal, a second end of said first horizontal passage an electric conductor insulated from said body disposed therein, one end of said electrical conductor being connected to the solenoid of said safety valve and another other end of said electrical conductor being connected with to said second terminal.

3. A safety apparatus for use with a gas burner having a thermoelectrically activated safety valve for interrupting a flow of gas to said burner, a governor for maintaining constant gas pressure to said burner, a gas channel interconnecting said safety valve and said governor, and a thermocouple for generating a thermoelectromotive force in the presence of a pilot flame a pilot burner to electrically maintain said safety valve in an open position, said safety apparatus comprising:

a gas pressure operator for sensing excessive pressure within said gas channel interconnecting said safety valve and said governor and initiating a shut-off of said gas supply to said burner upon sensing said excessive pressure;

connecting means electrically connected to a solenoid in said safety valve for controlling on/off operation of said safety valve, and electrically connected to said thermocouple; and operation sensing means in communication with said gas pressure operator electrically disconnecting the generated thermoelectromotive force supplied to said safety valve so that said safety valve moves to an off position thereby stopping the flow of gas within said channel and extinguishing the flame at said burner.

4. A gas burner control device comprising a connecting device for coupling a thermocouple to a safety valve solenoid through a operation sensing device, said connecting device comprising:

a body having a first horizontal passage and a longitudinal passage formed therein;

a plug inserted into said longitudinal passage and having a second horizontal passage formed therein cooperating with said first horizontal passage;

a first terminal and a second terminal positioned at opposing ends of said second horizontal passage;

an insulating block disposed between and spacing part said first terminal and said second terminal;

wherein said body electrically couples an exposed wire of said thermocouple at a first end of said first horizontal passage, an insulated wire of said thermocouple passes into said first end of said first horizontal passage to electrically couple said first terminal, and a second end of said first horizontal passage has disposed therein a transmission means insulated from said body, one end of said transmission means being connected with to said safety value solenoid and another end of said transmission means being connected with to said second terminal.

5. A gas burner control device according to claim 4, wherein said safety value controls the flow of gas to said gas burner and said operation sensing device electrically disconnects said first terminal from said second terminal in response to abnormal operating conditions to close said safety valve.

6. A gas burner control device according to claim 5, wherein said operation sensing device comprises a plurality of sensors for detecting abnormal operating conditions.

7. A gas burner control device according to claim 5, wherein said gas burner control device further comprises:

a governor for maintaining constant gas pressure to gas burners; and a spring biased button for opening said safety valve to begin said flow of gas to said gas burner.

8. A gas burner control device according to claim 5, wherein said gas burner control device further comprises a gas pressure operator for actuating said operation sensing device to disconnect said first terminal from said second terminal in response to high gas pressure.

* * * * *

UNITED STATES PATENT AND TRADEMARK OFFICE

CERTIFICATE OF CORRECTION

PATENT NO. : 5,181,846

DATED : 26 January 1993

INVENTOR(S) : Ui Young Chang

It is certified that error appears in the above-identified patent and that said Letters Patent is hereby corrected as shown below:

On the title page: Item [75] Inventors:

Change "Ui Y. Chang" to --Ui Young Chang--.

Signed and Sealed this

Twenty-sixth Day of October, 1993

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,181,846
DATED : Jan. 26, 1993
INVENTOR(S) : Ui-Young Chang

It is certified that error appears in the above-indentified patent and that said Letters Patent is hereby corrected as shown below:

Column 1, Line 19, after "burner", change "causing" to -- causes --;

Column 5, Line 17, after "feeds", change "though" to -- through --;

IN THE CLAIMS

Column 6, Claim 3

Line 39, after "flame", insert -- emanating --;

Claim 4

Line 60, preceding "operation", change "a" to -- an --;

UNITED STATES PATENT AND TRADEMARK OFFICE

CERTIFICATE OF CORRECTION

PATENT NO. : 5,181,846
DATED : Jan. 26, 1993
INVENTOR(S) : Ui-Young Chang

It is certified that error appears in the above-indentified patent and that said Letters Patent is hereby corrected as shown below:

IN THE CLAIMS

Column 7, Claim 4

Line 13, preceding "solenoid", change "value" to -- valve --;

Claim 5

Line 18, after "safety", change "value" to -- valve --:

Signed and Sealed this

Nineteenth Day of September, 1995

*Attest:*

Bruce Lehman

BRUCE LEHMAN

*Attesting Officer*

*Commissioner of Patents and Trademarks*